US006659008B2

(12) United States Patent
Mutschall et al.

(10) Patent No.: US 6,659,008 B2
(45) Date of Patent: Dec. 9, 2003

(54) DEVICE HAVING A CYLINDER INCLUDING A GRIPPER SYSTEM

(75) Inventors: Stefan Mutschall, Walldorf (DE); Norbert Thünker, Hirschberg (DE)

(73) Assignee: Heidelberger Druckmaschinen AG, Heidelberg (DE)

( * ) Notice: Subject to any disclaimer, the term of this patent is extended or adjusted under 35 U.S.C. 154(b) by 0 days.

(21) Appl. No.: 10/079,076

(22) Filed: Feb. 20, 2002

(65) Prior Publication Data

US 2002/0112627 A1 Aug. 22, 2002

(30) Foreign Application Priority Data

Feb. 20, 2001 (DE) ..... 101 07 858

(51) Int. Cl.[7] ..... B41F 27/12; B41F 21/00

(52) U.S. Cl. ..... 101/409; 101/415.1; 101/246; 271/277

(58) Field of Search ..... 101/415.1, 409, 101/378, 246; 271/277, 82, 85

(56) References Cited

U.S. PATENT DOCUMENTS 4,475,459 A 10/1984 Wanke et al.
4,759,290 A * 7/1988 Holl et al. ..... 101/415.1
5,839,366 A 11/1998 Schaede

FOREIGN PATENT DOCUMENTS

| | | |
|---|---|---|
| DE | 1 611 297 | 12/1970 |
| DE | 2 135 714 | 3/1972 |
| DE | 30 49 067 C2 | 7/1982 |
| DE | 196 17 544 C1 | 4/1997 |
| DE | 199 09 686 A1 | 9/2000 |
| EP | 0 769 376 B1 | 4/1997 |
| GB | 1 343 084 | 1/1974 |

* cited by examiner

*Primary Examiner*—Leslie J. Evanisko
(74) *Attorney, Agent, or Firm*—Laurence A. Greenberg; Werner H. Stemer; Ralph E. Locher

(57) ABSTRACT

A device includes a cylinder having a gripper system for holding a sheet of printable material, the gripper system having at least one gripper mounted so as to be pivotable relative to at least one gripper support and being capable of performing a dipping movement into a channel formed in the cylinder below an outer jacket contour thereof, and having a control cam for controlling the pivoting of the gripper relative to the gripper support, the control cam also serving to control the dipping movement of the gripper system into the channel.

11 Claims, 3 Drawing Sheets

DEVICE HAVING A CYLINDER INCLUDING A GRIPPER SYSTEM

BACKGROUND OF THE INVENTION

Field of the Invention

The invention relates to a device having a cylinder including a gripper system for holding a sheet of printable material, the gripper system possessing at least one gripper mounted so as to be pivotable relative to at least one gripper support and being capable of dipping into a channel of the cylinder below the outer jacket contour of the cylinder, and having a control cam for controlling the pivoting of the gripper relative to the gripper support.

Devices of the foregoing type referred to herein have become known heretofore. They include a cylinder having a gripper system with a plurality of grippers, customarily, the grippers projecting over the jacket surface of the cylinder. When the cylinder cooperates with a counter-cylinder, for example, a blanket cylinder, gravure cylinder, flexographic printing cylinder or the like, the counter-cylinder must have a channel for receiving the grippers therein. In order to be able to use a counter-cylinder having a continuous jacket surface, devices have become known wherein the grippers of the gripper system can be dipped into a channel of the cylinder below the outer jacket contour of the cylinder.

The published German Non-prosecuted Patent Application (DE-OS) 16 11 297 discloses a cylinder having a gripper system wherein the dipping movement of the gripper system into a channel of the cylinder below the outer jacket contour of the cylinder is controlled by a cam disk. A further control cam is required in order to pivot the pivotably mounted grippers relative to a gripper support into an opening position and a clamping position. A disadvantage thereof is the elaborate and hence cost-intensive structure of the gripper system.

The published German Non-prosecuted Patent Application (DE-OS) 21 35 714 discloses a cylinder having a radially extending slit wherein there is guided a linearly displaceable clamping bar for holding a sheet of printable material. When the clamping bar is moved into the slit, the sheet of printable material is clamped between the clamping bar and the slit wall. The dipping and clamping movement of the clamping bar is controlled by a stationary control cam.

The published German Patent Document DE 30 49 067 C2 discloses a device wherein, to actuate the grippers of the gripper system, a gripper opening cam and a further control cam for controlling the dipping of the grippers into the channel of the cylinder are provided.

The published European Patent Document EP 0 769 376 B1 discloses a device wherein both a gripper opening cam for opening and closing the dipping grippers and a further control cam for controlling the dipping movement of the dipping grippers are provided. The effort required for constructing the device is correspondingly great.

SUMMARY OF THE INVENTION

It is an object of the invention to provide a device having a cylinder including a gripper system of the general type described in the introduction hereto that has a relatively simple structure and operates with functional reliability.

With the foregoing and other objects in view, there is provided, in accordance with one aspect of the invention, a device comprising a cylinder having a gripper system for holding a sheet of printable material, the gripper system having at least one gripper mounted so as to be pivotable relative to at least one gripper support and being capable of performing a dipping movement into a channel formed in the cylinder below an outer jacket contour thereof, and having a control cam for controlling the pivoting of the gripper relative to the gripper support, the control cam also serving to control the dipping movement of the gripper system into the channel.

In accordance with another feature of the invention, the gripper is drive-connected to a coupler of a swivel-joint transmission.

In accordance with a further feature of the invention, the gripper is connected to the coupler for performing a pivoting movement.

In accordance with an added feature of the invention, the device includes a swivel joint via which the gripper is connected to the coupler.

In accordance with yet another feature of the invention, the gripper is rigidly connected to the coupler of the swivel-joint transmission.

In accordance with yet a further feature of the invention, the gripper support is spring-mounted by at least one spring element.

In accordance with yet an added feature of the invention, the swivel-joint transmission is a four-membered coupler transmission.

In accordance with yet an additional feature of the invention, transmission members of the coupler transmission are of such size, and pivots of the coupler transmission are disposed in such a manner that the gripper, during a last phase of a closing operation thereof, serves to describe a section of a path of movement which is straight and at least approximately perpendicular relative to the gripper support.

In accordance with still another feature of the invention, the gripper support, during the dipping movement of the gripper system, is mounted so as to move exclusively in the direction of the dipping movement in order to avoid relative movements between the gripper and the gripper support.

In accordance with still a further feature of the invention, the device includes a swivel joint forming an axle for articulatedly connecting the gripper to the gripper support.

In accordance with a concomitant aspect of the invention, there is provided a printing press including a device comprising a cylinder having a gripper system for holding a sheet of printable material, the gripper system having at least one gripper mounted so as to be pivotable relative to at least one gripper support and being capable of performing a dipping movement into a channel formed in the cylinder below an outer jacket contour thereof, and having a control cam for controlling the pivoting of the gripper relative to the gripper support, the control cam also serving to control the dipping movement of the gripper system into the channel.

Thus, the device according to the invention comprises a cylinder having a gripper system for retaining a sheet of printable material, for example, a sheet of paper or cardboard. The gripper system possesses at least one gripper mounted pivotably relative to a gripper support, and between the gripper and the gripper support the sheet of printable material to be transferred from the cylinder can be retained with clamping. To control the pivoting movement of the gripper relative to the gripper support, a control cam is provided. The at least one gripper and the at least one gripper support are so formed that they can be dipped into a channel formed in the outer shell or jacket surface of the cylinder, below the outer shell or jacket contour of the cylinder. The device according to the invention has the feature that the control cam is also used to control the dipping movement of the gripper system into the channel, i.e., the control cam serves both for controlling the pivoting of the gripper relative to the gripper support and for controlling the dipping movement of the gripper system into the channel. Because of the dual function of the control cam, the structure of the device according to the invention can be simplified by comparison with heretofore known devices of this general type.

Other features which are considered as characteristic for the invention are set forth in the appended claims.

Although the invention is illustrated and described herein as embodied in a device having a cylinder including a gripper system, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings, wherein:

DESCRIPTION OF THE PREFERRED EMBODIMENTS

Figure 1A:
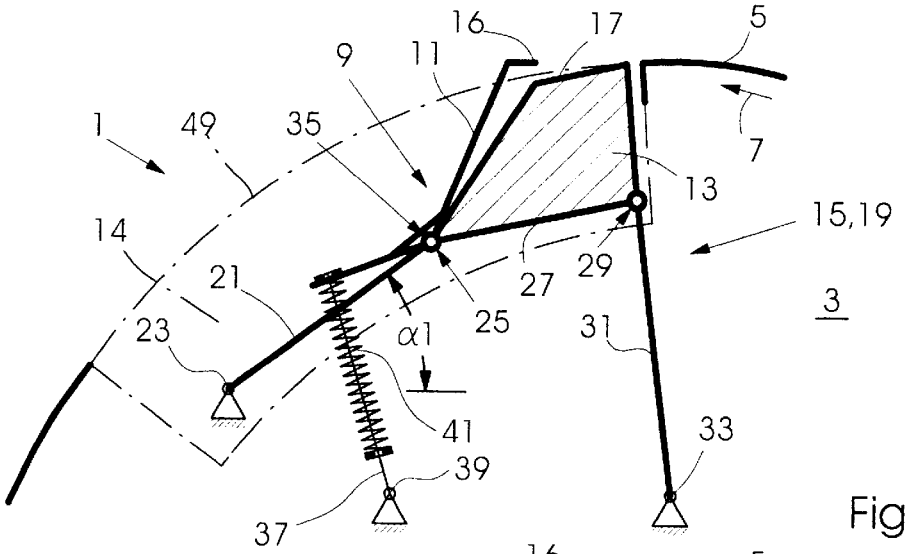
FIGS. 1*a* to 1*c*, respectively, are basic diagrams of a first embodiment of a gripper system in various positions and operating phases.

Referring now to the drawings and, first, particularly to FIGS. 1*a* to 1*c* thereof, there is shown therein the device 1 described hereinbelow, which can be utilized generally, for example, in a sheet-fed printing press that can be used for a wide variety of printing processes, such as, for example, screen printing, offset printing, gravure printing, and so forth.

FIG. 1*a* is a basic diagram of a first embodiment of the device 1, which includes a cylinder 3 of which only part of the outer shell or jacket 5 is identifiable. A direction of movement of the outer shell or jacket 5 is represented by an arrow 7. The cylinder 3 serves for transferring, preferably while retaining register, a non-illustrated sheet of printable material from a section of the press located upline from the device 1, for example, an upline cylinder, to a downline section of the press, for example, a downline cylinder, the transfer of the sheet of printable material again preferably taking place while retaining register.

To hold the sheet of printable material on the outer shell or jacket 5 of the cylinder 3, a gripper system 9 is provided, which has at least one gripper 11 and at least one gripper support 13. The gripper 11 is pivotably mounted and can be pivoted with the aid of a transmission 15 relative to the gripper support 13 in a manner that the sheet of printable material can be clampingly retained between a gripper tip 16 and a support surface 17 of the gripper support 13. The gripper system 9 is disposed in a channel 14, merely suggested in the figures, which is provided in the outer shell or jacket 5 of the cylinder 3. The channel 14 extends in the longitudinal direction of the cylinder 3.

Figure 1B:
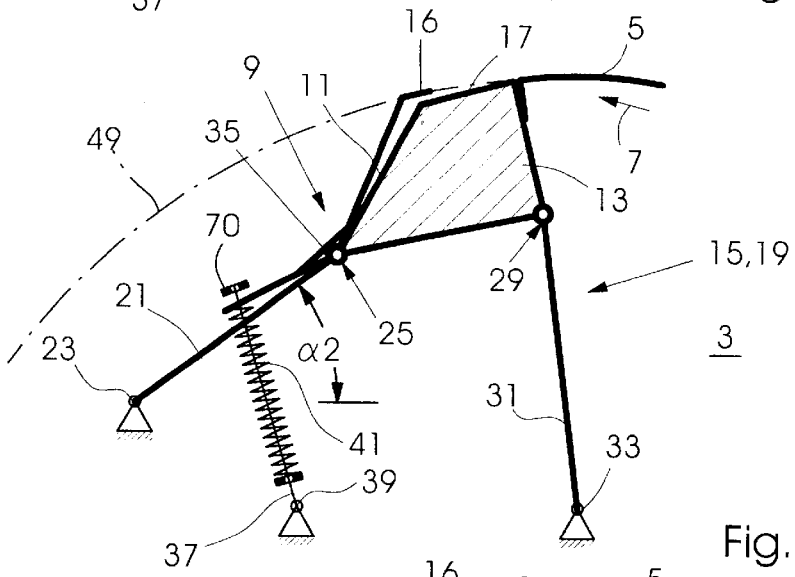
Figure 1C:
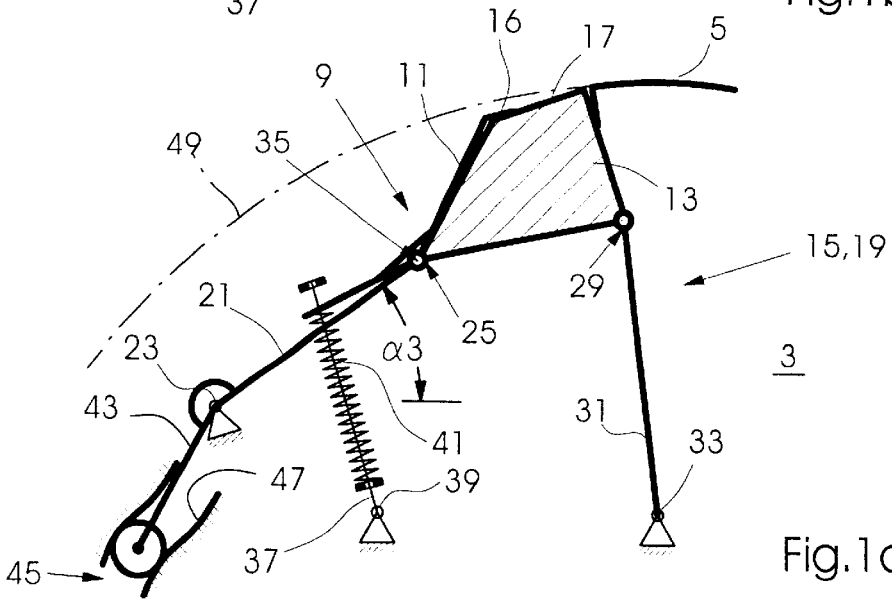

The transmission 15 is a swivel-joint transmission which, in the embodiment described with reference to FIGS. 1*a* to 1*c* is formed as a four-membered linkage or coupler transmission 19. It includes a first rocker arm 21, which is pivotably movable about a first axle 23 disposed locally fixed in the cylinder 3. The first rocker arm 21 is connected via a first pivot or swivel joint 25 to a coupler 27, whereon the gripper support 13 is rigidly attached. The coupler 27 is connected via a second pivot or swivel joint 29 to a second rocker arm 31, which is pivotable about a likewise stationary second axle 33.

The gripper 11 formed as a cranked or bent pivot lever is connected via a swivel joint 35 to the coupler 27. The gripper 11 is coupled, at the end thereof distal from the gripper tip 16, to a lever 37, which controls the pivoting movement of the gripper 11 about the swivel joint 35. The lever 37 is mounted so as to be pivotable about a third axle 39, which is locally fixed relative to the cylinder 3. Disposed on the lever 37 is a spring element 41, in this case formed by a helical spring, which, in the event of a movement of the gripper system 9 out of a raised position thereof shown in FIG. 1*a* into a dipped position thereof shown in FIG. 1*c*, is compressed by the gripper 11, as is described hereinafter in greater detail. According to FIG. 1*a*, the spring element 41 does not exert a strong force on the gripper 11, while the lever arm thereof opposite the gripper tip 16 rests on an adjustable stop 70, which is screwed onto the rod-shaped lever 37. The spring element 41 holds the gripper 11 only in the open position thereof. By an adjustment of the stop 70, as shown in FIG. 1*b*, the closure point of the gripper 11 is adjustable. According to FIGS. 1*b* and *c*, the gripper 11 is displaced from the stop 70 and exerts, via the spring element 41, a strong force on the stop 70 which determines the clamping force of the gripper 11.

The drive of the linkage or coupler transmission 19 is provided here via a roller lever 43 connected to the first coupler 21 and guided by a first control cam 45 fixed on the frame, only a portion of which is shown in FIG. 1*c*. A controlled-movement safety device securing the permanent contact of the cam roller of the roller lever 43 with the control cam 45 is provided, and is formed by shaping the control cam 45 as a grooved cam 47, so that the cam roller is secured by a positive or formlocking connection against being lifted away from the control cam 45. Of course, the controlled movement safety device may instead also be provided by a non-positive or forcelocking connection, i. e., a spring element may be provided for holding the cam roller against the control cam 45, which also effects the restoration of the coupler structure. In this regard, it is noted that a formlocking connection is one which connects two elements together due to the shape of the elements themselves, as opposed to a forcelocking connection, which locks the elements together by force external to the elements.

The function of the gripper system 9 is described in detail hereinafter. In the position of the linkage or coupler transmission 19 shown in FIG. 1*a*, the gripper system 9 disposed in the channel 14 is located in a raised position, wherein the gripper 11 is opened and projects over the outer jacket contour 49 of the cylinder 3 indicated in phantom. In this position of the gripper system 9, the sheet of printable material can rest with the leading edge thereof on the support surface 17.

By a pivoting movement of the first rocker arm 21 clockwise about the first axle 23, which is effected by activating the drive formed by the roller lever 43 (note FIG. 1*c*), the linkage or coupler transmission 19 is moved out of the position thereof shown in FIG. 1*a* into the intermediate position thereof shown in FIG. 1*b*. As a result of the movement of the linkage or coupler transmission 19, the gripper 11 has been pivoted clockwise about the swivel joint 35 into a closed position, wherein the gripper tip 16 presses with a defined force on the support surface 17 of the gripper support 13. This force is determined by the spring element 41, which, during the pivoting of the linkage or coupler transmission 19, is compressed by the end of the gripper 11 distal from the gripper tip 16. In the closed position of the gripper 11, as stated, the sheet of printable material is clamped between the gripper 11 and the gripper support 13. The movement of the linkage or coupler transmission 19 into the intermediate position shown in FIG. 1*b* further results in the gripper 11 having already dipped slightly into the channel 14, only a small portion thereof remaining projecting above the outer jacket contour 49 of the cylinder 3. Moreover, the gripper support 13 is tipped slightly counterclockwise about the pivot 29. It is noted that the gripper 11 has reached the position thereof before it has dipped fully into the channel 14.

In the course of the further pivoting of the first rocker arm 21 clockwise out of the position thereof shown in FIG. 1*b* into the position thereof shown in FIG. 1*c*, the gripper 11 dips fully into the channel 14 of the cylinder 3 below the outer jacket contour 49 of the cylinder 3. The non-illustrated sheet of printable material clamped between the support surface 17 and the gripper tip 16 is thus moved in the leading edge region thereof below the outer shell or jacket contour 49 of the cylinder 3. As a result of appropriate construction of the linkage or the coupler transmission 19, virtually no movement in the sheet feed direction takes place at the gripper support 13 after the sheet has been gripped.

It is noted that the gripper system 9, in the view of FIG. 1*a*, is disposed in a raised position relative to the outer shell or jacket contour 49 of the cylinder 3, while in the view of FIG. 1*c*, the gripper system 9 is fully dipped below the outer shell or jacket contour 49 of the cylinder 3. The gripper 11, in the raised position of the gripper system 9, is located in an open position relative to the gripper support 13 (FIG. 1*a*) and is pivoted into the closed position thereof (FIGS. 1*b*, 1*c*), relative to the gripper support 13, while still being dipped into the channel 14.

A particularly advantageous feature of the embodiment of the invention described with reference to FIGS. 1*a* to 1*c* is that both the pivoting of the gripper 11 relative to the gripper support 13, and the dipping movement of the gripper system 9 into the channel 14 are controlled by the same control cam 45. As a result, the structure of the device 1 can be simplified in comparison with heretofore known devices of this general type, and the costs thereof thereby reduced.

In the position of the linkage or coupler transmission 19 of FIG. *a*, wherein the gripper 11 is located in the opened position, the rocker arm 21 displays an angle $\alpha_1$ of approximately 40° relative to a theoretical horizontal. In order to move the gripper system 9 out of the raised position thereof into the intermediate position thereof shown in FIG. 1*b*, wherein the gripper 11 is already closed, the rocker arm 21 needs only to be pivoted clockwise through approximately 6°. The rocker arm 21, in the view according to FIG. 1*b*, displays an angle $\alpha_2$ relative to the horizontal of approximately 34°. In order to dip the gripper system 9 fully into the channel 14 in the cylinder 3 (FIG. 1*c*), it is merely necessary for the rocker arm 21 to be pivoted out of the position thereof shown in FIG. 1*b* through approximately a further 3° clockwise in order to arrive at the position thereof shown in FIG. 1*c*, wherein it now displays an angle $\alpha_3$ relative to the horizontal, which is approximately 31°. The radius of movement of the coupler or rocker arm 21 driven by the roller lever 43 is thus within an angular range of approximately 9°.

Figure 2:
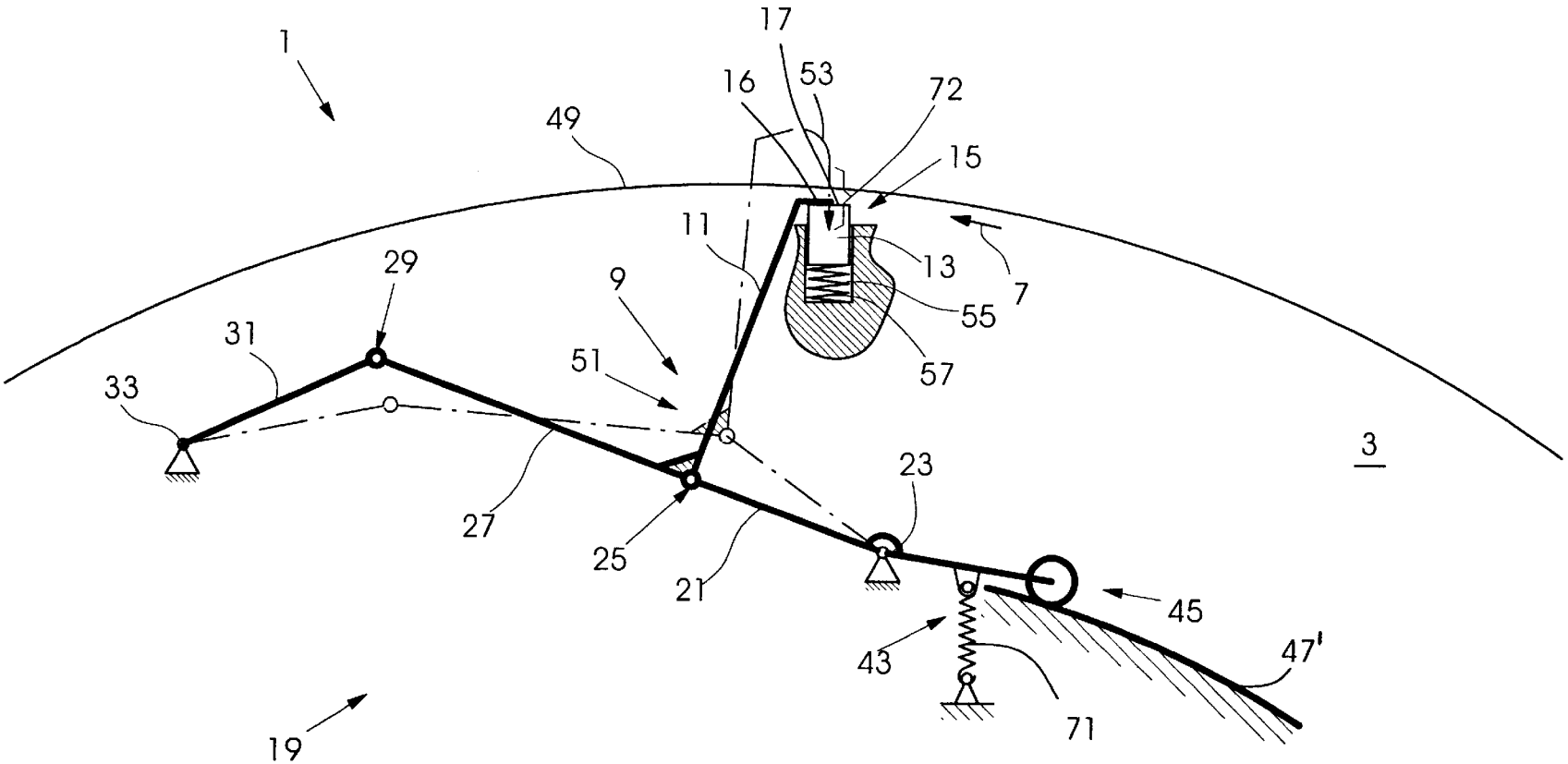
FIG. 2 is a basic diagram of a second embodiment of the gripper system.

FIG. 2 shows a further embodiment of the device 1. Like components in FIG. 2 are identified by the same reference numerals as in FIGS. 1*a* to 1*c*, so that for that purpose reference is made to FIGS. 1*a* to 1*c*. Only the differences are described in detail hereinbelow. In this regard, a rigid connection 51 exists between the gripper 11 and the coupler 27, effected for example by welding or the like or by forming the gripper 11 and the coupler 27 jointly as a single component. The gripper 11 is therefore no longer movable relative to the coupler 27 of the linkage or coupler transmission 19. As a result, the movement path 53 of the gripper tip 16 shown in phantom in FIG. 2 is obtained during a movement of the linkage or coupler transmission 19. The gripper support 13 is disposed in a slit-like recess 55 formed in the cylinder 3 and extending radially to the longitudinal axis of the cylinder 3, and is spring-mounted by a spring element 57, in this case formed as a helical spring.

FIG. 2 shows the linkage or coupler transmission 19 and the gripper 11 in phantom in a position thereof wherein the gripper 11 is located in the opened position thereof, wherein it no longer makes any contact with the support surface 17 of the gripper support 13 and projects out of the channel 14 over the outer jacket contour 49 of the cylinder 3. As a result of a movement of the linkage or coupler transmission 19, the gripper 11 is pivoted relatively to the gripper support 13 into the closed position thereof, wherein the gripper tip 16 initially presses against the support surface 17 of the gripper support 13, and, as a result of the continuation of the closing movement of the gripper 11 below the outer jacket contour 49, the gripper support 13 is pressed against the force of the spring element 57 into the recess 55. The gripper 11 is shown in solid lines in the dipped position thereof in the channel 14, wherein the gripper system 9 is fully dipped into the channel 14 below the outer jacket contour 49 of the cylinder 3. The transmission members of the linkage or coupler transmission 19 are of such size, and the pivots 25, 29, 33 are disposed in such a manner, that the gripper 11, during a last phase of the closing operation thereof, describes a movement path section 72 which is straight and at least approximately perpendicular relative to the gripper support 13. Consequently, during the contact thereof with the gripper support 13, the gripper tip 16 describes an at least approximately straight line, which virtually prevents a displacement of the gripper 11 on the gripper support 13.

The gripper support 13 is mounted so that, during the dipping movement of the gripper system 9 into the channel 14, the gripper support 13 moves at least approximately only in the direction of this dipping movement and with little divergence therefrom, this mounting also serving to prevent relative movements between the gripper 11 and the gripper support 13 during the dipping movement.

An advantageous aspect of the embodiment described with reference to FIG. 2 is that when the gripper 11 is set upon the gripper support 13, only the very slight mass of the gripper support 13 has to be coupled with the movement of the gripper 11.

The control cam 45 shown in FIG. 2 has, as a so-called open cam, only a single cam path 47', when the restoring movement of the linkage or coupler transmission 19 takes place with the aid of the spring element 71 functioning as a restoring element and as a controlled-movement safety device for the cam roller. Alternatively, the control cam 45 of the transmission shown in FIG. 2 can be formed as a grooved cam, in exactly the same way as the control cam shown in FIGS. 1*a* to 1*c*.

Figure 3C:
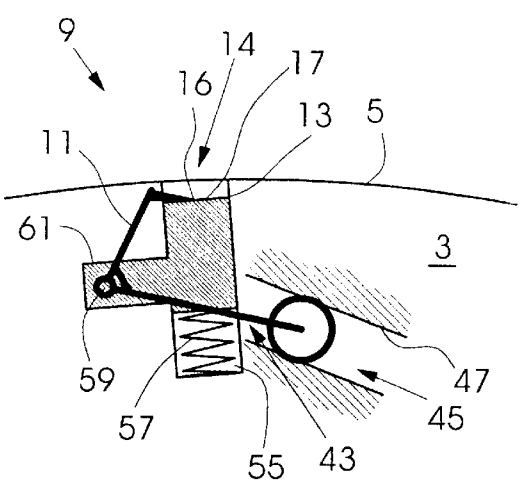
FIGS. 3*a* to 3*c*, respectively, are basic diagrams of a third embodiment of the gripper system in various positions and operating phases.
Figure 3B:
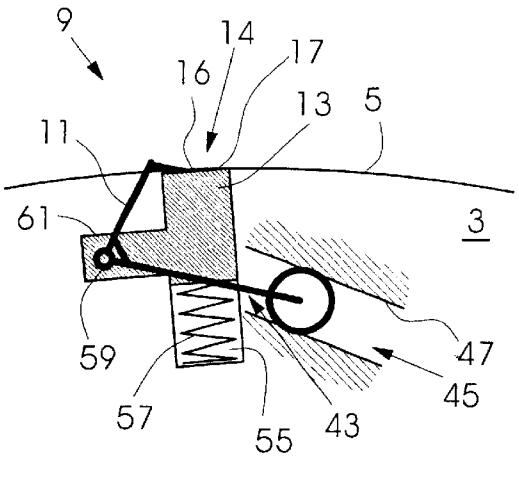
Figure 3A:
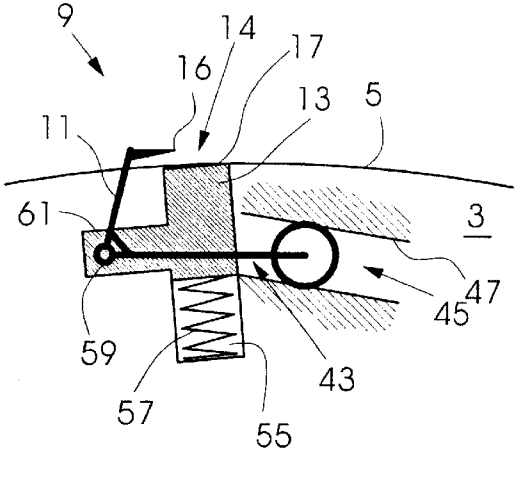

FIGS. 3*a* to 3*c*, respectively, show a section of a further embodiment of the gripper system 9, which differs from the gripper system 9 described with reference to FIG. 2, especially in that the gripper 11 is articulated on the gripper support 13. This means that the gripper is pivoted, with the aid of the roller lever 43 guided by the control cam 45 or alternatively by a coupler of the linkage or coupler transmission 19, about an axle 59, which is locally stationarily disposed on a bracket 61 rigidly connected to the gripper support 13. The result thereof is that the gripper 11, when pivoted about the axle 59 out of the opened position thereof (FIG. 3*a*) arrives in the closed position thereof (FIG. 3*b*), wherein the gripper tip 16 thereof presses on the support surface 17 of the gripper support 13, without the gripper system 9 being lowered here into the channel 14. Upon a continuation of the gripper pivot movement, the gripper 11 is dipped jointly with the spring-mounted gripper support 13 into the channel 14 of the cylinder 3 below the outer jacket contour of the cylinder 3.

It is common to the alternative embodiment of the gripper system 9 described with reference to FIGS. 2 and 3*a* to 3*c* that the gripper support 13 is pressed into the channel 14 below the outer jacket contour of the cylinder 3 by a continuation of the closing movement of the gripper 11.

It is common to all the alternative embodiments described with reference to FIGS. 1*a* to 3*c* that only one common control cam, specifically the control cam 45, is ever needed to control the pivoting of the gripper 11 relative to the gripper support 13 and to control the dipping movement of the gripper system 9 into the channel 14. The control cam 45, as described, can be disposed fixed to the frame, so that the roller lever 43 has to be moved in the guide (cam path 47) of the control cam 45, in order to move the linkage or coupler transmission 19 and, accordingly, the gripper 11. Alternatively, it is possible for the control cam 45 to be movable relative to the cylinder 3 and, accordingly, to the roller lever 43 fixed thereon, as a result of which the roller lever 43 is actuated, and the movement of the linkage or coupler transmission 19 is consequently triggered.

The gripper system 9 can, of course, also include a plurality of grippers, which are preferably disposed in pairs. One gripper support can be assigned to each pair of grippers, or alternatively a common gripper support can be assigned to all of the grippers. The grippers can also cooperate in groups with a gripper support.

We claim:

1. A device comprising a cylinder having a gripper system for holding a sheet of printable material, said gripper system having at least one gripper mounted so as to be pivotable relative to at least one gripper support and being capable of performing a dipping movement into a channel formed in said cylinder below an outer jacket contour thereof, and having a control cam for controlling the pivoting of said gripper relative to said gripper support, said control cam also serving to control said dipping movement of said gripper system into said channel.

2. The device according to claim 1, wherein said gripper is drive-connected to a coupler of a swivel-joint transmission.

3. The device according to claim 2, wherein said gripper is connected to said coupler for performing a pivoting movement.

4. The device according to claim 3, including a swivel joint via which said gripper is connected to said coupler.

5. The device according to claim 2, wherein said gripper is rigidly connected to said coupler of said swivel-joint transmission.

6. The device according to claim 2, wherein said swivel-joint transmission is a four-membered coupler transmission.

7. The device according to claim 7, wherein transmission members of said coupler transmission are of such size, and pivots of said coupler transmission are disposed in such a manner that said gripper, during a last phase of a closing operation thereof, serves to describe a section of a path of movement which is straight and at least approximately perpendicular relative to said gripper support.

8. The device according to claim 1, wherein said gripper support is spring-mounted by at least one spring element.

9. The device according to claim 1, wherein said gripper support, during said dipping movement of said gripper system, is mounted so as to move exclusively in the direction of said dipping movement in order to avoid relative movements between said gripper and said gripper support.

10. The device according to claim 1, including a swivel joint forming an axle for articulatedly connecting said gripper to said gripper support.

11. The device according to claim 1, wherein said gripper is movable relative to said coupler.

* * * * *